US010463171B2

(12) United States Patent
Healy et al.

(10) Patent No.: US 10,463,171 B2
(45) Date of Patent: Nov. 5, 2019

(54) ACTIVITY JUMPER

(71) Applicant: Skip Hop, Inc., New York, NY (US)

(72) Inventors: John Healy, Brooklyn, NY (US); Benjamin Bearsch, Brooklyn, NY (US); Petros Stombolis, Franklin Square, NY (US); Janet Villano, Jersey City, NJ (US)

(73) Assignee: SKIP HOP, INC., New York, NY (US)

( * ) Notice: Subject to any disclaimer, the term of this patent is extended or adjusted under 35 U.S.C. 154(b) by 38 days.

(21) Appl. No.: 15/713,020

(22) Filed: Sep. 22, 2017

(65) Prior Publication Data

US 2019/0069692 A1 Mar. 7, 2019

Related U.S. Application Data

(60) Provisional application No. 62/554,300, filed on Sep. 5, 2017.

(51) Int. Cl.

| | |
|---|---|
| ***F16M 13/00*** | (2006.01) |
| ***A47B 81/00*** | (2006.01) |
| ***A47D 13/10*** | (2006.01) |
| ***A47D 1/00*** | (2006.01) |
| ***A47D 3/00*** | (2006.01) |
| ***A63H 33/00*** | (2006.01) |

(52) U.S. Cl.

CPC ..... *A47D 13/107* (2013.01); *A47D 1/004* (2013.01); *A47D 3/001* (2017.05); *A63H 33/006* (2013.01)

(58) Field of Classification Search

CPC ..... A47D 13/107; A47D 3/00; A47D 13/046; A47D 13/08; A63H 33/006

See application file for complete search history.

(56) References Cited

U.S. PATENT DOCUMENTS

| | | | |
|---|---|---|---|
| 5,499,949 | A | 3/1996 | Heubl |
| 5,518,475 | A | 5/1996 | Garland |
| 5,690,383 | A | 11/1997 | Meeker |
| 5,728,030 | A | 3/1998 | Hsieh |
| 5,857,944 | A | 1/1999 | Cone et al. |
| 6,932,709 | B1 | 8/2005 | Gubitosi et al. |

(Continued)

FOREIGN PATENT DOCUMENTS

| | | |
|---|---|---|
| CN | 201238876 | 5/2009 |
| CN | 201822376 | 5/2011 |

(Continued)

OTHER PUBLICATIONS

Preliminary European Search Report dated Nov. 20, 2018 in corresponding European Patent Application No. 18 18 1120.

*Primary Examiner* — Shin H Kim

(74) *Attorney, Agent, or Firm* — Stephen J. Weyer, Esq.; James R. Hayne, Esq.; Stites & Harbison, PLLC

(57) ABSTRACT

An activity jumper for a child includes a base and two vertical supports operably connected to the base. The vertical supports extend upward from the base with each vertical support including two arms that extend away from the vertical support. A plurality of stretchable tension members are each operably connected to one of the two arms of one of the two vertical supports and a tabletop is suspended by the tension members, the tabletop having a top play surface and a central opening with a child seat disposed in the central opening. A method of storing an activity jumper is also provided.

28 Claims, 9 Drawing Sheets

(56) References Cited

U.S. PATENT DOCUMENTS

| | | | | |
|---|---|---|---|---|
| 6,994,630 | B2 | 2/2006 | Paesang | |
| 7,182,993 | B1 | 2/2007 | Hamilton | |
| 7,438,644 | B2 | 10/2008 | Gubitosi et al. | |
| 7,614,979 | B2 * | 11/2009 | Thomson | A47D 1/002 472/118 |
| 7,727,076 | B2 | 6/2010 | Bapst et al. | |
| 7,878,915 | B2 | 2/2011 | Myers et al. | |
| D650,207 | S | 12/2011 | Soriano et al. | |
| D650,208 | S | 12/2011 | Soriano et al. | |
| 8,070,617 | B2 | 12/2011 | Barron et al. | |
| 8,182,355 | B2 | 5/2012 | Bapst et al. | |
| 8,267,803 | B2 * | 9/2012 | Trapp | A47D 13/107 446/227 |
| 8,357,054 | B2 | 1/2013 | Myers et al. | |
| D675,454 | S | 2/2013 | Soriano et al. | |
| D685,197 | S | 7/2013 | Soriano et al. | |
| 8,702,526 | B2 | 4/2014 | Myers et al. | |
| 8,708,875 | B2 | 4/2014 | Prohaska et al. | |
| 8,845,441 | B2 * | 9/2014 | Trapp | A47D 13/107 446/227 |
| 8,951,132 | B2 | 2/2015 | Xu | |
| 8,968,110 | B2 | 3/2015 | Bapst et al. | |
| 9,010,711 | B2 | 4/2015 | Pleiman et al. | |
| 9,144,324 | B1 | 9/2015 | Champagne et al. | |
| 9,204,733 | B2 | 12/2015 | Welch et al. | |
| 2005/0264088 | A1 | 12/2005 | Tadin et al. | |
| 2006/0111196 | A1 * | 5/2006 | Henry | A63G 3/02 472/128 |
| 2006/0237944 | A1 * | 10/2006 | Thomson | A47D 1/002 280/250.1 |
| 2008/0012409 | A1 | 1/2008 | Chen et al. | |
| 2009/0033133 | A1 | 2/2009 | Barron et al. | |
| 2009/0200841 | A1 | 8/2009 | Rhoten | |
| 2010/0231015 | A1 | 9/2010 | Lundeen | |
| 2010/0320821 | A1 * | 12/2010 | Trapp | A47D 13/107 297/274 |
| 2012/0119549 | A1 * | 5/2012 | Speedie | A47D 9/02 297/217.4 |
| 2013/0093227 | A1 | 4/2013 | Mendes et al. | |
| 2013/0306826 | A1 | 11/2013 | Pleiman et al. | |
| 2013/0319884 | A1 | 12/2013 | Gomez | |
| 2015/0282641 | A1 | 10/2015 | Crane et al. | |
| 2016/0286977 | A1 | 10/2016 | Thomson et al. | |
| 2018/0035824 | A1 * | 2/2018 | Goh | A47D 1/02 |

FOREIGN PATENT DOCUMENTS

| | | |
|---|---|---|
| CN | 105 231 725 | 1/2016 |
| CN | 205 144 102 | 4/2016 |
| CN | 205 144 104 | 4/2016 |
| CN | 205 144 108 | 4/2016 |
| WO | WO-2010006472 | 1/2010 |

* cited by examiner

ACTIVITY JUMPER

CROSS REFERENCE TO RELATED APPLICATION

This disclosure claims priority to U.S. provisional patent application Ser. No. 62/554,300 filed Sep. 5, 2017, herein incorporated by reference.

FIELD OF INVENTION

The present invention relates to a activity jumper for an infant and toddler and in particular an activity jumper with numerous visual, sensory and auditory elements.

BACKGROUND OF THE INVENTION

Infants and toddlers develop physically and mentally by interacting with their environment. In order to present an infant with different stimuli, companies have developed toys, gyms and the like. An activity jumper is a recently developed product which integrates or combines elements to entertain and educate an infant and toddler.

SUMMARY OF THE INVENTION

The present invention relates to a unique, new activity jumper which includes numerous innovations over prior known activity jumpers. One exemplary activity jumper includes a tabletop which is suspended by way of stretchable tension members from two vertical supports which are held upright by two base assemblies connecting two stabilizing members to form a substantially oval base, as further discussed below.

Each of the vertical supports has two arms that extend away from the vertical support at a distance away from the upper end of the vertical support. In particular, each of the arms extends away from the vertical support in substantially opposite directs and at a slightly upward angle. Furthermore, the arms are offset such that an upper arm is connected to the vertical support closer to the upper end of the vertical support than a lower arm. In some exemplary embodiments the upper arm is offset from the lower arm by about 2 inches, however, other offset distance are possible without departing from the spirit and scope of the present invention.

Each of the arms extends away from the respective vertical support and terminates in a respective distal end. One of four tension members is operably connected to each of the distal ends of the arms with the tabletop operably connected to the other end of the tension members so as to suspend the tabletop from the two vertical supports.

With respect to the tension members, each of the tension members includes a first strap operably connected to one of the two arms of the vertical supports, a second strap operably connected to the tabletop, and a piston connected to and extending between the first strap and the second strap. The piston of each of the tension members includes an inner member and an outer member that are slidably connected to form a housing that encloses a spring. The first strap extends through a hole at the end of the inner member and connects to one end of the spring and the second strap similarly extends through a hole at the end of the outer member and connects to the other end of the spring.

When the activity jumper is in an unloaded state, the spring of each of the pistons is substantially relaxed and the inner member of the piston is almost entirely contained within the outer member of the piston. In the exemplary activity jumper, however, the first and second straps are comprised of a non-elastic or minimally elastic material. As such, when the activity jumper is in a loaded state, the straps do not stretch, and all of the load is transferred through the two straps and into the spring of each of the pistons, causing the spring to stretch. The piston further includes a safety strap connected to the ends of each of the two straps adjacent and substantially parallel to the spring. For example, the safety strap can be sewn to the ends of each of the straps adjacent to either end of the spring. The safety strap is slack when the spring is relaxed, but safety strap straightens as the spring is stretched. Accordingly, the safety strap limits the maximum length that the spring, and therefore the piston, can extend, thus preventing the inner member of the piston from sliding completely out of the outer member of the piston and exposing the enclosed spring. According to some embodiments of the present invention, the safety strap limits the extension of the spring to less than or equal to about 6 inches, less than or equal to about 5 inch, less than or equal to about 4 inches, and preferably less than or equal to about 3.75 inches.

As previously mentioned, the second straps are operably connected to the tabletop. In particular, each second strap is removably connected to the underside of the tabletop by a height adjustment means. In some exemplary activity jumpers, there are four height adjustment means positioned on the bottom surface of the tabletop with each height adjustment means including a plurality of hooks along the bottom surface of the tabletop and which are aligned in a row perpendicular to a rim extending around the perimeter of the tabletop. At the end of each of the second straps is an oval ring, or clip that is configured to removably engage one of the hooks of the height adjustment means, depending on the preferred height setting of the tabletop. According to one particular embodiment of the present invention, in the shortest height setting, the tabletop is suspended about 14.5 inches from the ground and in the tallest height setting, the tabletop is suspended about 19.5 inches from the ground.

In one exemplary implementation of the method of the present invention, an exemplary activity jumper of the present invention in a deployed configuration is folded into a stored configuration. In a first step, the tension members connected to each of the arms of one of the vertical supports are disconnected from the tabletop. In particular, the clip at the end of the second straps are unhooked from the hooks of the respective height adjustment means on the underside of the tabletop. The second straps associated with the one vertical support are then removed from the t-shaped slots so that the two second straps are no long connected to the tabletop whatsoever. The tabletop is then preferably allowed to hang from the other vertical support to which it is still connected. In a second step, the still connected vertical support is unlocked from its respective base assembly. In particular, the base assembly includes a push button which is depressed to unlock the vertical support from the base assembly. Next, in a third step, the vertical support is pulled upward until it is completely out of the receiving hole and in a fourth step, the vertical support is rotated downwards towards the center of the activity jumper, i.e., towards the other vertical support. Next, in a fifth, sixth, and seventh step, the second, and previously disconnected, vertical support is unlocked, pulled upward, and rotated downwards towards the center of the activity jumper in substantially the same manner as the first, connected vertical support. Lastly, in an eight step, the two vertical supports are secured to the tabletop. Of course, it should be understood that the exemplary activity jumper can similarly be unfolded from the stored configuration into the deployed configuration simply by reversing the order of the steps described above.

DETAILED DESCRIPTION

The present invention will now be described with reference to the Figures. It will be appreciated that other activity jumpers and appearances are possible which are consistent with the described function of the activity jumper.

Figure 1:
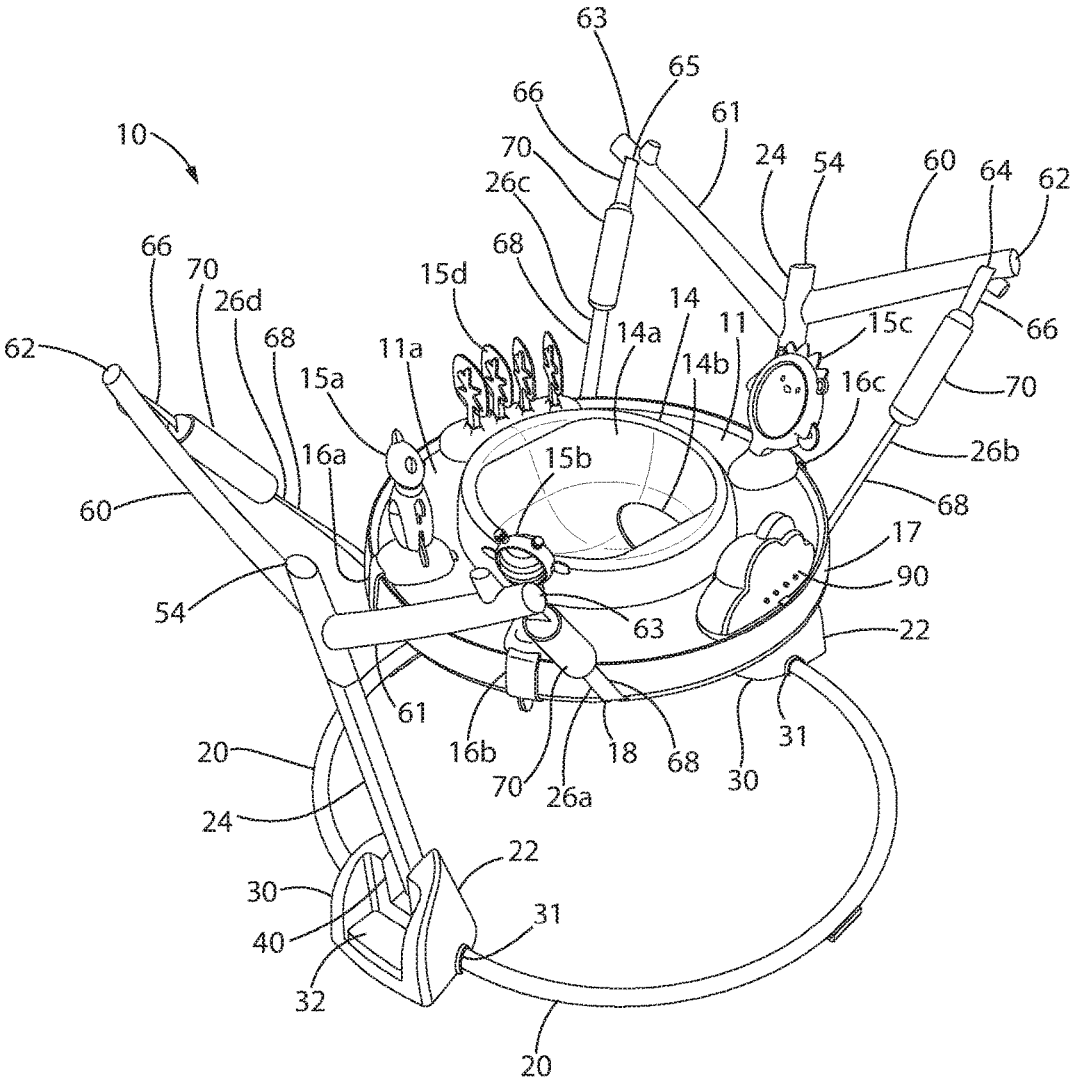
FIG. 1 is a front, left, top perspective view of an activity jumper made in accordance with the present invention shown in a deployed configuration.

Referring first to FIG. 1, the present invention is directed to an activity jumper 10 for a child. The exemplary activity jumper 10 includes a tabletop 11 which is suspended by way of stretchable tension members 26*a*-26*d* from two vertical supports 24 which are held upright by two base assemblies 22 connecting two stabilizing members 20 to form a substantially oval base, as further discussed below.

Figure 2:
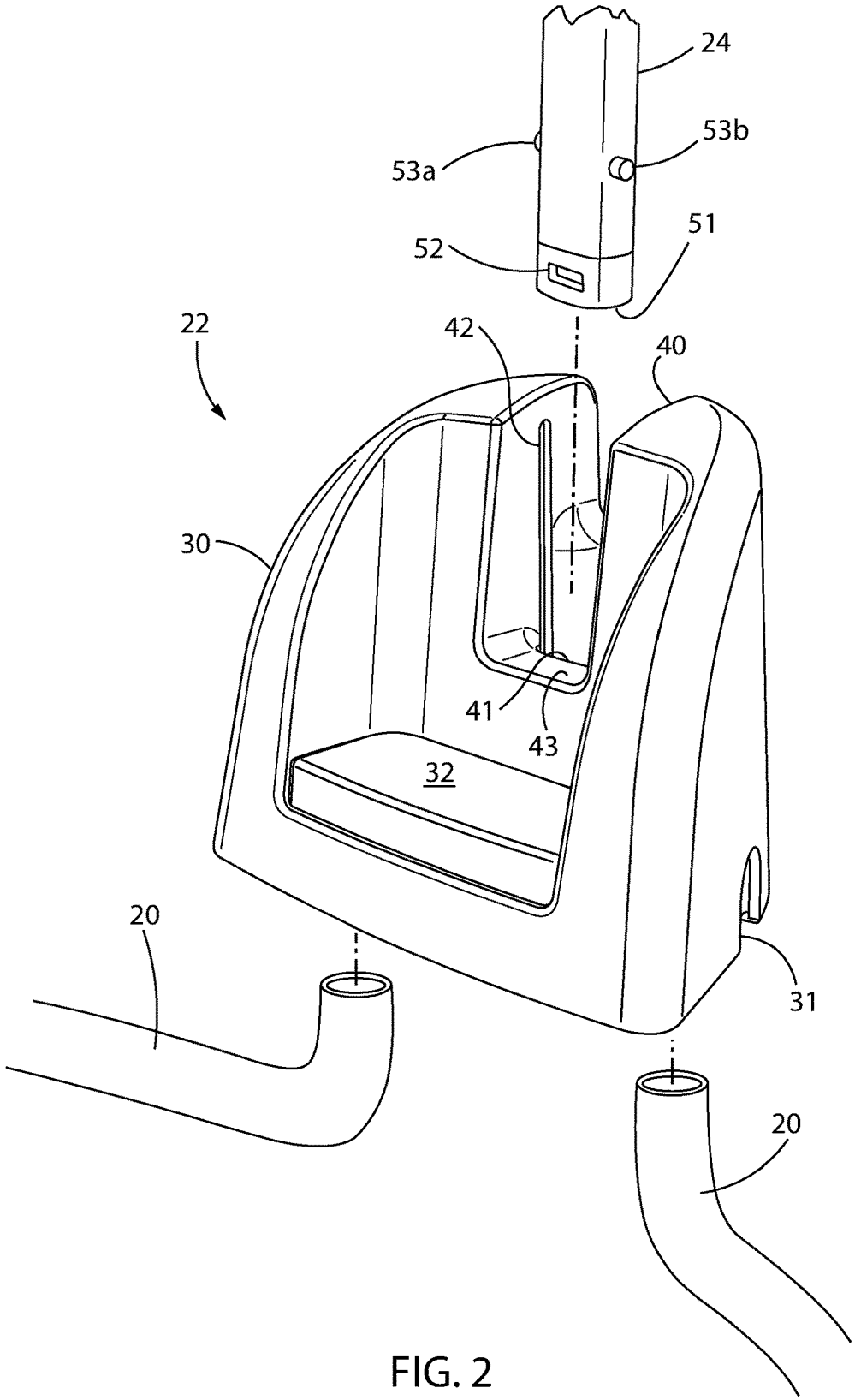
FIG. 2 is a partially exploded view of one of the base assemblies of the activity jumper of FIG. 1.
Figure 3:
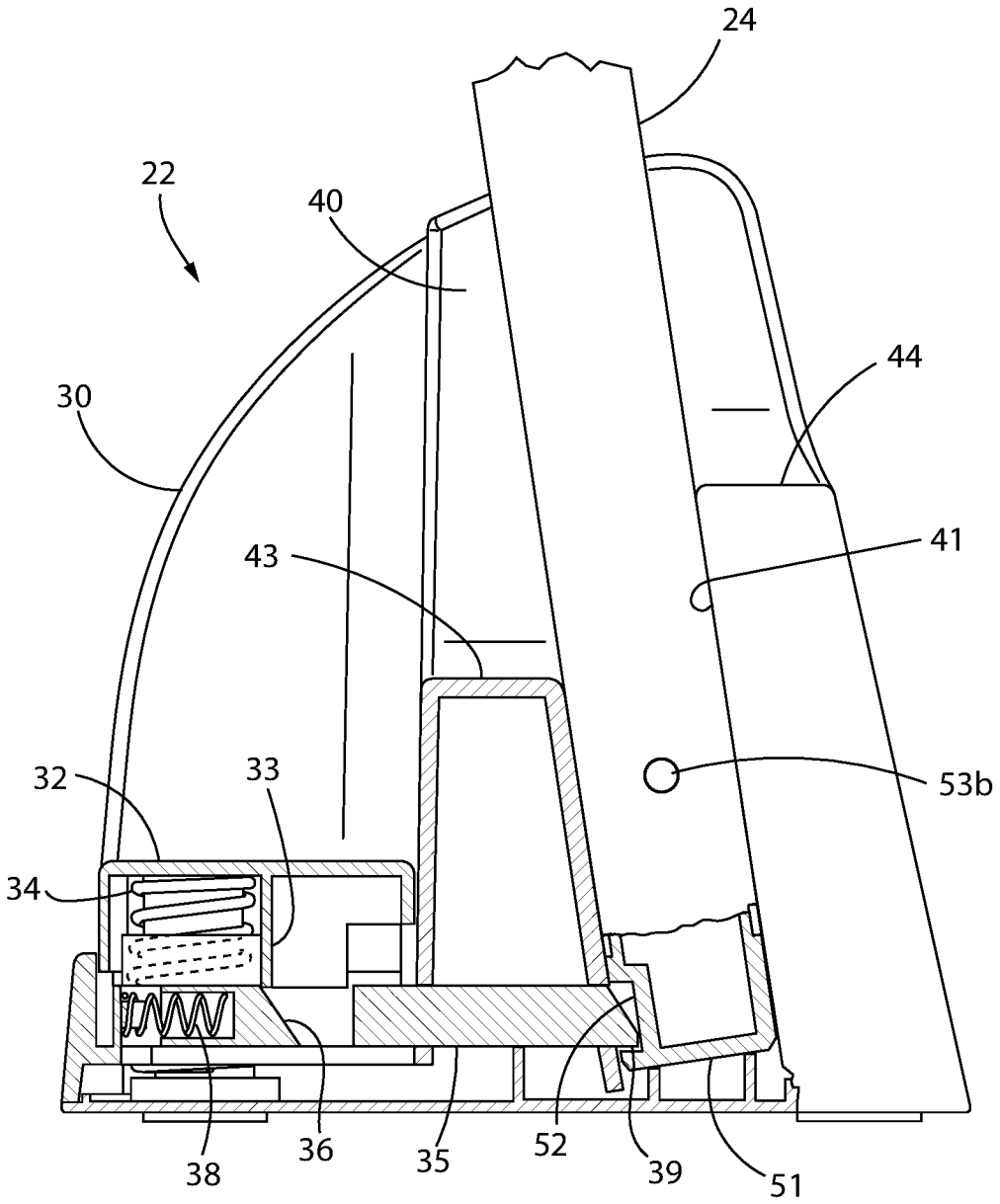
FIG. 3 is a partial cross-sectional view of the base assembly of FIG. 2.

Referring still to FIG. 1, but now additionally to FIGS. 2 and 3, in this exemplary embodiment the two stabilizing members 20 are in the form of curved tubes or pipes having ends which are bent at substantially 90°. Each of the base assemblies 22 includes a main body 30 which define an opening 31 on either side of the main body 30 (only one opening 31 shown) which accept the ends of the stabilizing members 20. In particular, the bent ends of the stabilizing members 20 are inserted into the main body 30 with the length of the stabilizing member 20 extending outward through the opening 31 in the side of the main body 30. Once the end of the stabilizing member 20 is in place within the base assembly 22, the stabilizing member 20 can be secured to the base assembly 22 with a screw or the like. Of course, other means of connecting the stabilizing members 20 to the base assemblies 22 are also contemplated without departing from the spirit and scope of the present invention.

Figure 8:
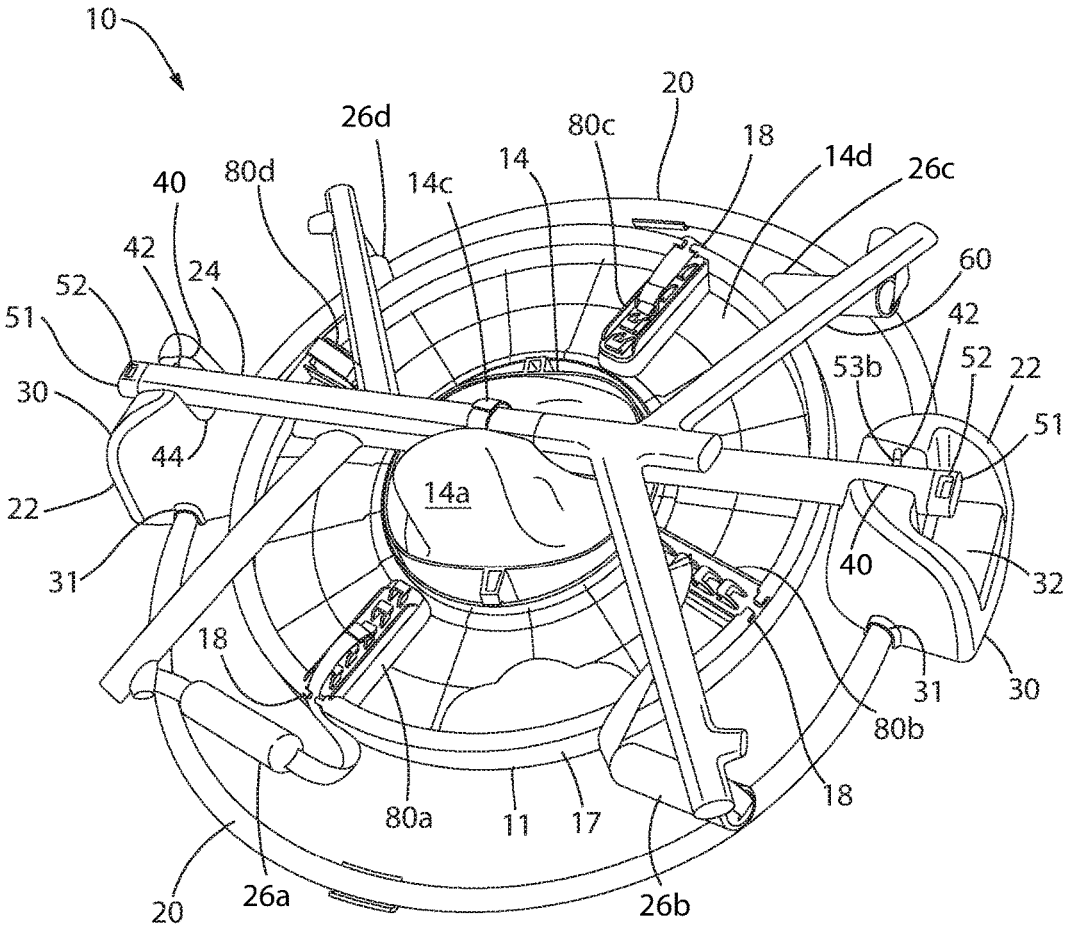
FIG. 8 is a front, left, top perspective view of the activity jumper of FIG. 1 shown in a stored configuration.

As perhaps best shown in FIG. 2, each of the base assemblies 22 further defines a lateral channel 40 with a receiving hole 41 extending downward from the bottom of the channel 40. The receiving hole 41 is configured to accept one of the vertical supports 24 and secure the vertical support 24 in a vertical, deployed position, such as shown in FIG. 1. Furthermore, the base assembly 22 includes a push button 32 which is used to unlock the vertical support 24 and allow the vertical support 24 to be folded into a horizontal, stored configuration, such as shown in FIG. 8, and as discussed further below.

Referring still to FIGS. 1-3, when the vertical support 24 is in the vertical, deployed position, a lower end 51 of the vertical support 24 is positioned within the receiving hole 41 defined in the main body 30 of the base assembly 22 with an upper end 54 of the vertical support 24 positioned substantially above the base assembly 22. As shown in FIG. 3, however, the receiving hole 41 is formed at an angle, and therefore, as perhaps best shown in FIGS. 4A and 5A, in the exemplary activity jumper 10, the vertical supports 24 angle slightly outward, improving the overall stability of the activity jumper 10. As shown in FIG. 1, each of the vertical supports 24 has two arms 60, 61 that extend away from the vertical support 24 at a distance away from the upper end 54 of the vertical support 24. In particular, each of the arms 60, 61 extends away from the vertical support 24 in substantially opposite directs and at a slightly upward angle. Furthermore, the arms 60, 61 are offset such that an upper arm 60 is connected to the vertical support 24 closer to the upper end 54 of the vertical support 24 than a lower arm 61. In the exemplary embodiment shown in the Figures, the upper arm 60 is offset from the lower arm 61 by about 2 inches, however, other offset distance are possible without departing from the spirit and scope of the present invention.

Referring still to FIG. 1, each of the arms 60, 61 extends away from the respective vertical support 24 and terminates in a respective distal end 62, 63. One of four tension members 26*a*-26*d* is operably connected to each of the distal ends 62, 63 of the arms 60, 61 with the tabletop 11 operably connected to the other end of the tension members 26*a*-26*d* so as to suspend the tabletop 11 from the two vertical supports 24.

Figure 4A:
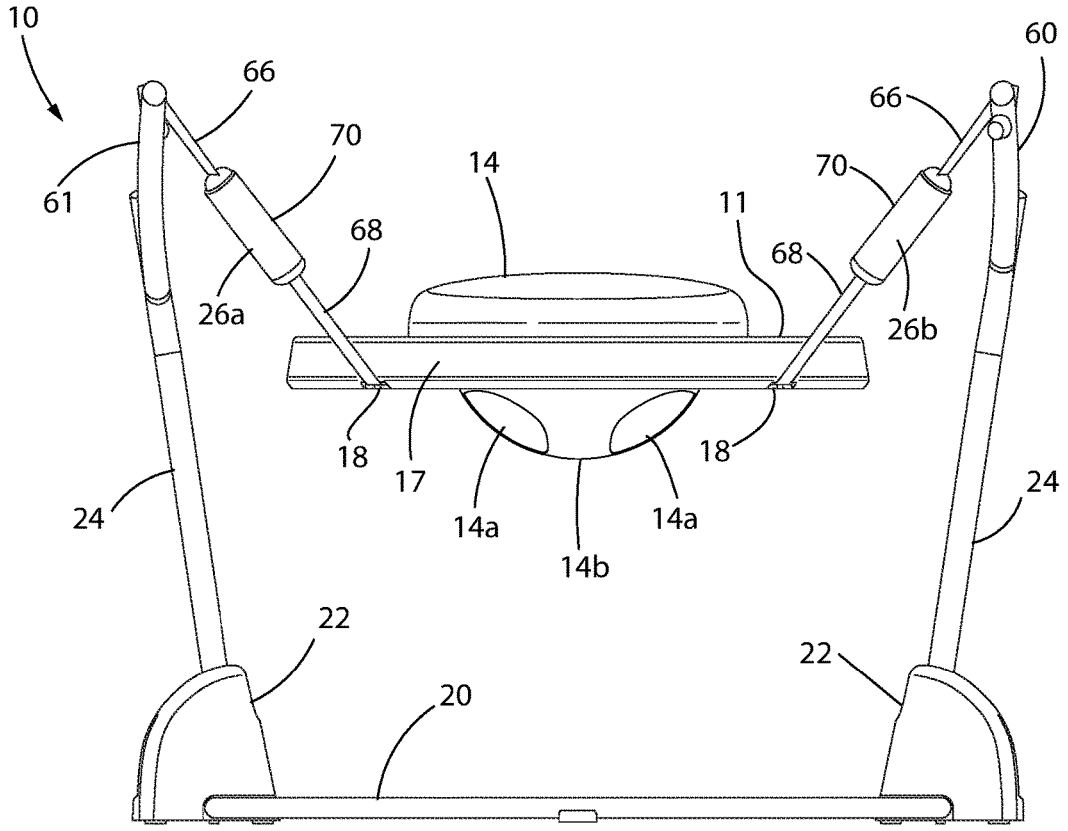
FIG. 4A is a side view of the activity jumper of FIG. 1 shown in an unloaded state.
Figure 5A:
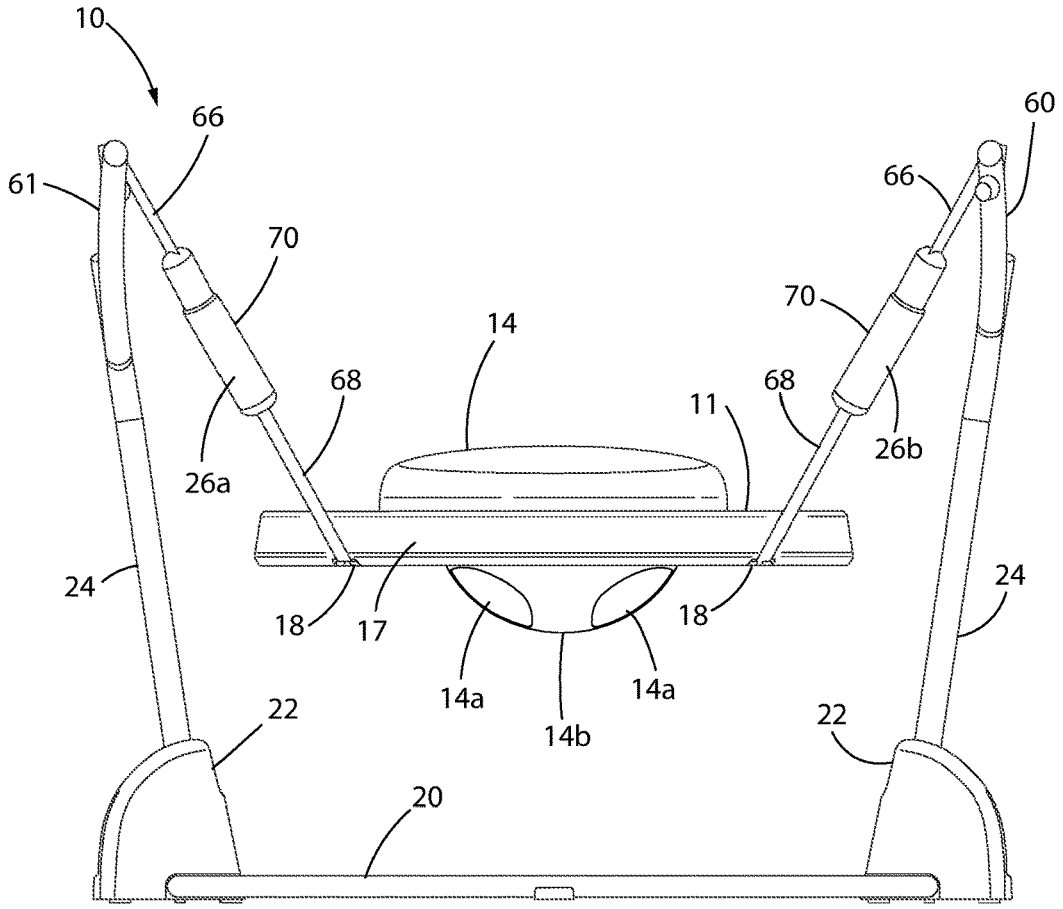
FIG. 5A is a side view of the activity jumper of FIG. 1 shown in a loaded state.

With respect to the tension members 26*a*-26*d*, and referring now specifically to FIGS. 1, 4A, and 5A, each of the tension members 26*a*-26*d* includes a first strap 66 operably connected to one of the two arms 60, 61 of the vertical supports 24, a second strap 68 operably connected to the tabletop 11, and a piston 70 connected to and extending between the first strap 66 and the second strap 68. With respect to the connection between the first strap 66 and the arms 60, 61 of the vertical supports 24, and as perhaps best shown in FIG. 1, each of the arms 60, 61 define a slit 64, 65 adjacent to the respective distal end 62, 63 and the first strap 66 of each of the tension members 26*a*-26*d* is affixed within the arm 60, 61 so as to extend out of the slit 64, 65. Of course, other means of securing the first straps 66 are possible without departing from the spirit and scope of the present invention. The means for connecting the second straps 68 to the tabletop 11 is discussed in further detail below with reference to FIG. 6.

Referring now specifically to FIGS. 4A and 5A, the piston 70 of each of the tension members 26*a*-26*d* includes an inner member 72 and an outer member 74 that are slidably connected to form a housing that encloses a spring 76. In the exemplary embodiment, both the inner member 72 and the outer member 74 are formed of a substantially rigid material, such as a plastic. The first strap 66 extends through a hole at the end of the inner member 72 and connects to one end of the spring 76 and the second strap 68 similarly extends through a hole at the end of the outer member 74 and connects to the other end of the spring 76.

Figure 4B:
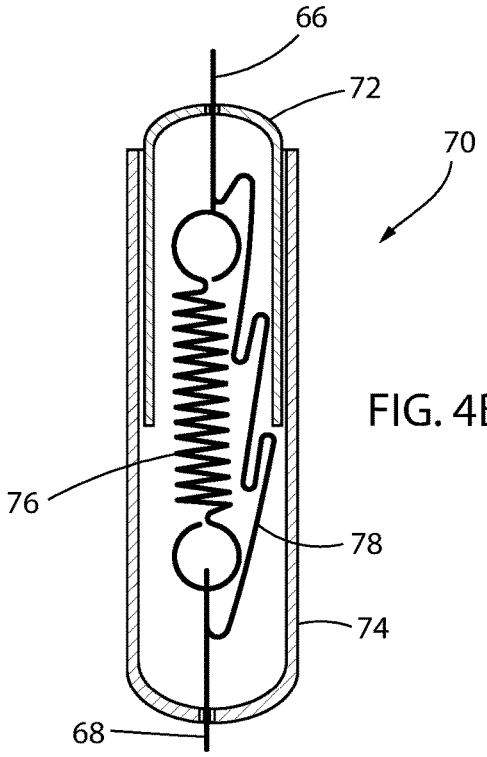
FIG. 4B is a detailed cross-sectional view of one of the pistons of FIG. 4A.
Figure 5B:
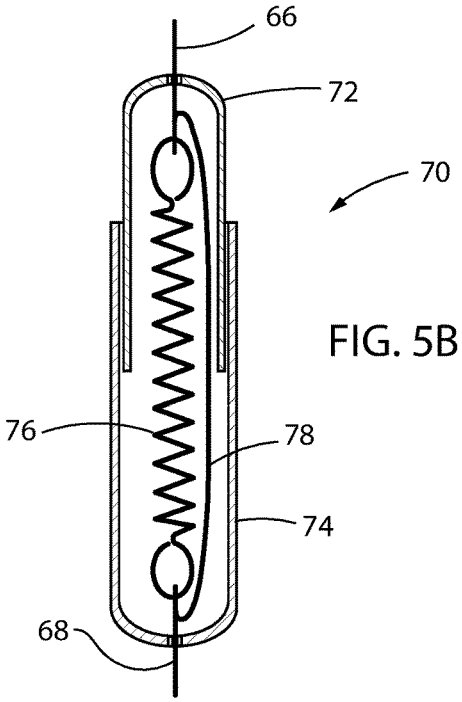
FIG. 5B is a detailed cross-sectional view of one of the pistons of FIG. 5A.

When the activity jumper 10 is in an unloaded state, such as shown in FIGS. 4A and 4B, the spring 76 of each of the pistons 70 is substantially relaxed and the inner member 72 of the piston 70 is almost entirely contained within the outer member 74 of the piston 70. In the exemplary activity jumper 10, however, the first and second straps 66, 68 are comprised of a non-elastic or minimally elastic material. As such, when the activity jumper 10 is in a loaded state, such as shown in FIGS. 5A and 5B, the straps 66, 68 do not stretch, and all of the load is transferred through the two straps 66, 68 and into the spring 76 of each of the pistons 70, causing the spring 76 to stretch. Although not expressly shown, the inner member 72 and the outer member 74 of the piston 70 are operably connected to the two ends of the spring 76, such that, as the spring 76 stretches, the inner member 72 of the piston 70 slides further out of the outer member 74 of the piston 70. As also shown in FIGS. 4B and 5B, the piston 70 further includes a safety strap 78 connected to the ends of each of the two straps 66, 68, adjacent and substantially parallel to the spring 76. For example, the safety strap 78 can be sewn to the ends of each of the straps 66, 68 adjacent to either end of the spring 76. As shown in FIG. 4B, the safety strap 78 is slack when the spring 76 is relaxed, but, as shown in FIG. 5B, the safety strap 78 straightens as the spring 76 is stretched. Accordingly, the safety strap 78 limits the maximum length that the spring 76, and therefore the piston 70, can extend, thus preventing the inner member 72 of the piston 70 from sliding completely out of the outer member 74 of the piston 70 and exposing the enclosed spring 76. According to some embodiments of the present invention, the safety strap 78 limits the extension of the spring 76 to less than or equal to about 6 inches, less than or equal to about 5 inch, less than or equal to about 4 inches, and preferably less than or equal to about 3.75 inches.

As previously mentioned, in the exemplary activity jumper 10, the first and second straps 66, 68 are comprised of a non-elastic or minimally elastic material such that any change in the length of the tension members 26*a*-26*d* is caused entirely by the piston 70. Alternatively, one or more of the straps may be composed of an elastic material, such that, when the activity jumper is in the loaded configuration, the straps themselves are elongated in addition to, or instead of, the piston elongating.

Figure 6:
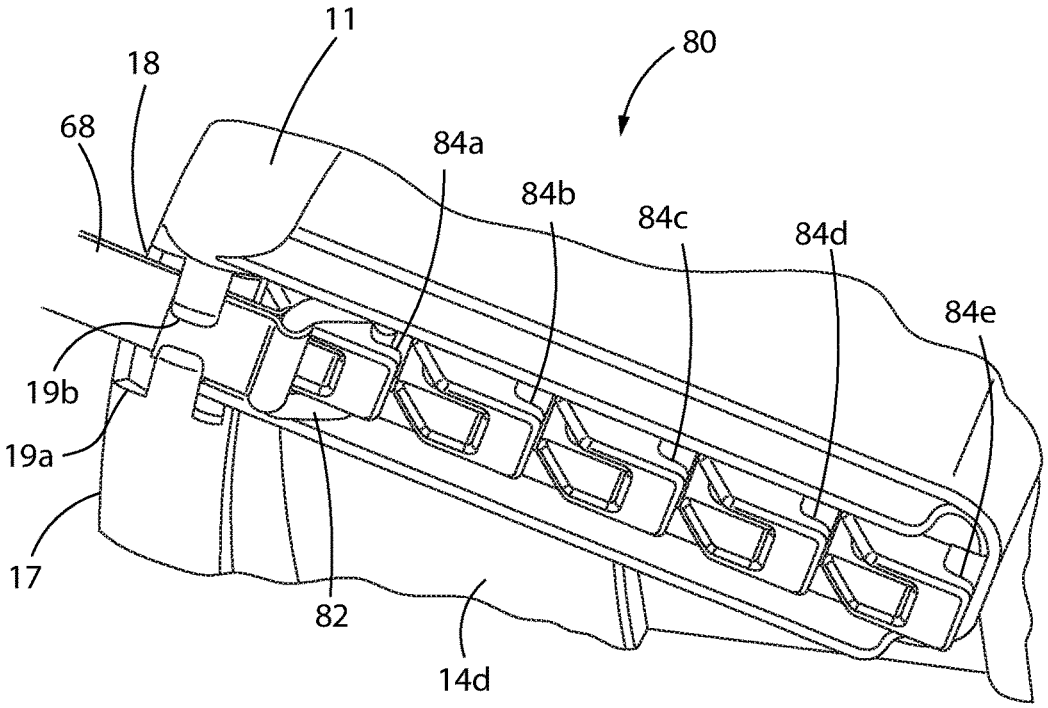
FIG. 6 is a detailed view of one of the height adjustment means on the bottom of the tabletop of the activity jumper of FIG. 1.
Figure 7:
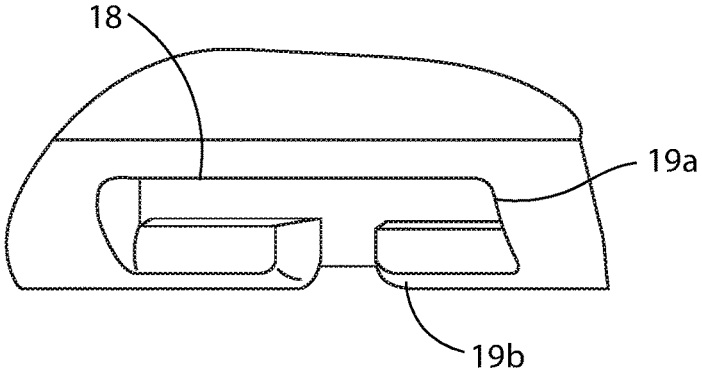
FIG. 7 is a detailed view of the t-shaped channel that holds the straps adjacent to the tabletop of the activity jumper of FIG. 1.

As previously mentioned, the second straps 68 are operably connected to the tabletop 11. In particular, and referring now to FIGS. 6-8, an exemplary second strap 68 is removably connected to the underside of the tabletop 11 by a height adjustment means 80*a*-80*d*. In particular, as shown in FIG. 8, in the exemplary activity jumper 10, there are four height adjustment means 80*a*-80*d* positioned on the bottom surface 14*d* of the tabletop 11. As shown in FIG. 6, an exemplary height adjustment means 80 includes a plurality of hooks 84*a*-84*e* along the bottom surface 14*d* of the tabletop 11 and which are aligned in a row perpendicular to a rim 17 extending around the perimeter of the tabletop. At the end of each of the second straps 68 is an oval ring, or clip 82 that is configured to removably engage one of the hooks 84*a*-84*e* of the height adjustment means 80, depending on the preferred height setting of the tabletop 11. For example, if the clip 82 of each of the second straps 68 is placed around the respective first hooks 84*a* which is located closest to the rim 17 of the tabletop 11, as is shown in FIG. 6, the tabletop 11 will be at its shortest height setting since the majority of the second strap 68 will extend past the tabletop 11. By comparison, if the clip 82 of each of the second straps 68 is placed around the respective fifth hooks 84*e* located further away from the rim 17 of the tabletop 11, a larger portion of the second strap 68 must extend from the rim 17 to the location of the fifth hook 84*e* and therefore the tabletop 11 will be at its tallest height setting. Of course, placing the clip 82 around any of the other intermediate hooks 84*b*-84*d* will result in a correspondingly intermediate height setting. According to one particular embodiment of the present invention, in the shortest height setting, the tabletop 11 is suspended about 14.5 inches from the ground and in the tallest height setting, the tabletop 11 is suspended about 19.5 inches from the ground.

The rim 17 of the tabletop 11 further defines four t-shaped slots 18 located immediately adjacent to each of the height adjustment means 80*a*-80*d*. The slots 18 maintain the alignment of the second strap 68 with the respective height adjustment means 80*a*-80*d*. In particular, as perhaps best shown in FIG. 7, each of the t-shaped slots 18 include an upper channel 19*a* with a width substantially the same as, or larger than, the width of the second strap 68 and a lower channel 19*b* with a width substantially smaller than the width of the second strap 68. The second straps 68 are therefore readily retained within the upper channel 19*a* of the slot 18, but, by manipulating the second straps 68 through the lower channel 19*b* of the slot 18, the second straps 68 are still capable of being removed from the tabletop 11 if desired, for example, to store the activity jumper 10, as further discussed below.

With respect to the tabletop 11 itself, and referring now to FIGS. 1, 4A, 5A, and 8, the tabletop 11 is substantially circular and has a central opening in which a child seat 14 is located. The upper or top surface of the tabletop 11 acts as a play surface 11*a* for a child seated in the seat 14, and the seat 14 is configured to rotate so as to allow the child to easily access the entirety of the tabletop 11 and any items attached or placed on the tabletop 11, as further discussed below.

In the exemplary child seat 14 illustrated, the seat 14 is comprised of a seat attachment ring (not shown) surrounded by a seating fabric 14*a*. As shown in FIGS. 1, 4A, and 5A, in operation, the seat 14 is situated on top of the tabletop 11 such that the seating fabric 14*a* hangs below the upper or top play surface 11*a* of the tabletop 11. Preferably, the seating fabric 14*a* is removably secured to the seat 14 to allow for the seating fabric 14*a* to be removed for cleaning and/or storage. When attached, the seating fabric 14*a* hangs through the central seating opening in the tabletop 11. The illustrated seating fabric 14*a* includes two leg holes 14*b* through which the legs of a child may be inserted. The seating fabric 14*a* may be comprised of any number of fabrics, either a single type of fabric or multiple types of fabric. In the exemplary child seat 14 illustrated, the seating fabric 14*a* is comprised of a minimally stretching fabric (or fabric with a protective washable liner) so that the child seated in the seat 14 is maintained in a substantially fixed height relative to the tabletop 11. U.S. patent application Ser. No. 15/429,855, which is entitled "INFANT ACTIVITY CENTER," describes additional details regarding child seats suitable for use with the activity jumper 10 of the present invention, and is incorporated herein by reference.

Referring still to FIG. 1, a number of toys 15*a*-15*d* (accessories) can be locked in place on the tabletop 11 using a bracket or clip 16*a*-16*d*, which is attached to the rim 17 around the perimeter of the tabletop 11. The clips 16*a*-16*d* allows the toys 15*a*-15*d* to be securely placed on the tabletop 11 and positioned where a parent wishes them to be located on the tabletop 11. Furthermore, using clips 16*a*-16*d* allows the tabletop 11 surface to be free of holes, recesses, depressions, lower portions, pockets, etc., where one would locate a toy to limit its movement on the surface. This provides a clean, flat, planar circumferential surface, around the perimeter of the tabletop 11. U.S. patent application Ser. No. 15/429,855, which is entitled "INFANT ACTIVITY CENTER," also describes additional details regarding toys and clips suitable for use with the activity jumper 10 of the present invention, as well as features of the tabletop itself.

In operation, a child is placed in the seat 14 of the activity jumper 10. Preferably the second straps 68 are adjusted so that when the tabletop 11 loaded with the child's weight and the child's legs extend through the leg holes 14*b*, the child is able to stand on the ground while still being substantially supported by the seat 14. Accordingly, the child is able to jump up and down with the pistons 70 of the tension members 26*a*-26*d* provided the necessary elasticity to allow the tabletop 11 to move along with the child. To this end, in addition to the various toys 15*a*-15*d* removably locked into place around the tabletop 11, the exemplary activity jumper 10 further includes an electronic counter 90 that tracks this up-and-down motion of the tabletop 11.

Figure 9:
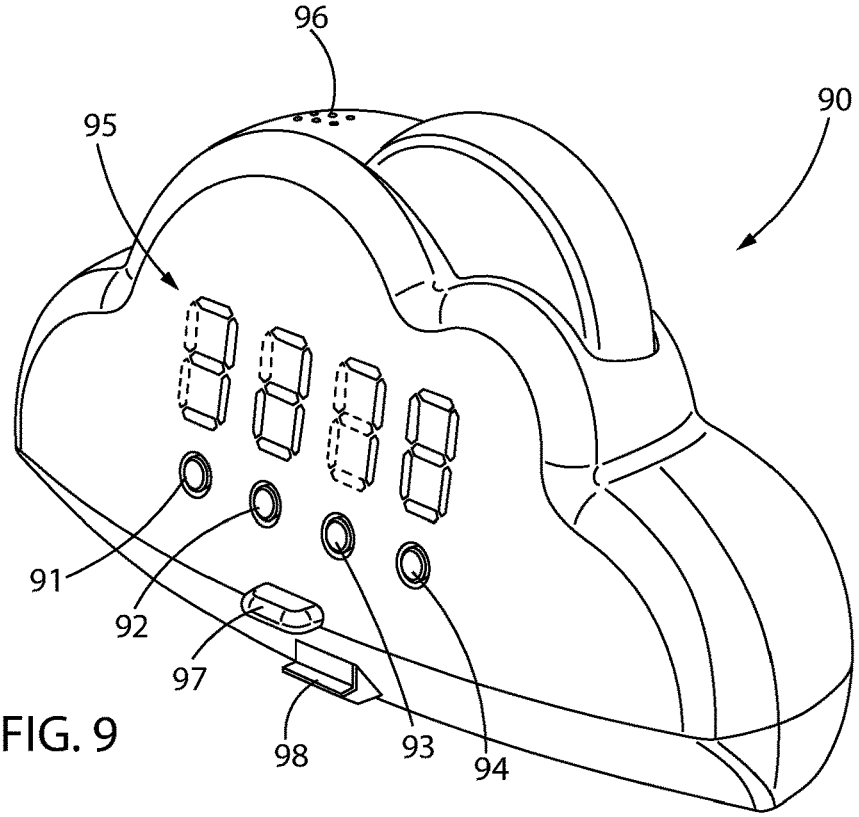
FIG. 9 is a front, right, top perspective view of the electronic counter of the activity jumper of FIG. 1.
Figure 10:
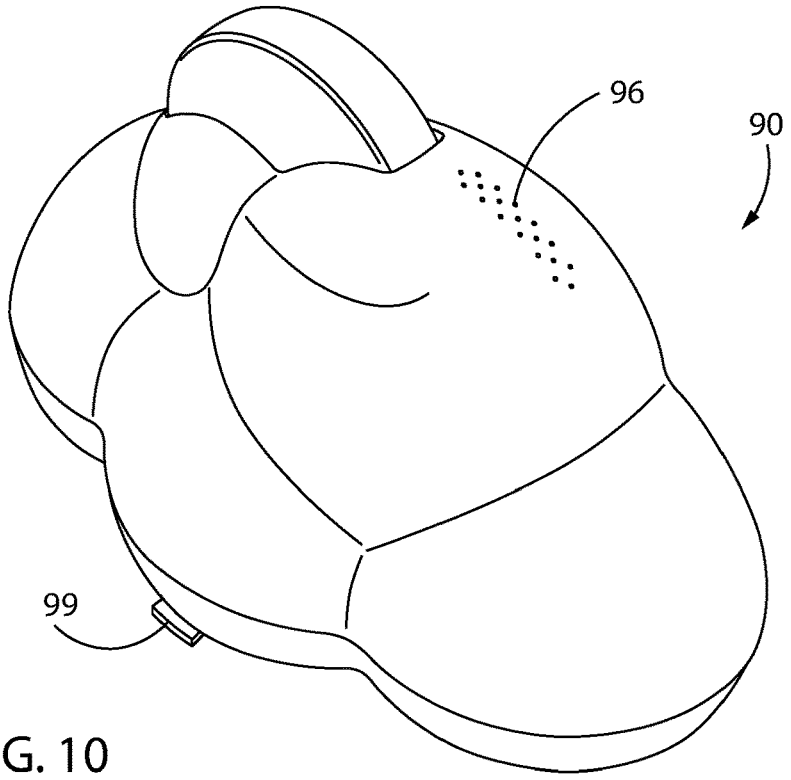
FIG. 10 is a rear, left, top perspective view of the electronic counter of FIG. 9.
Figure 11:
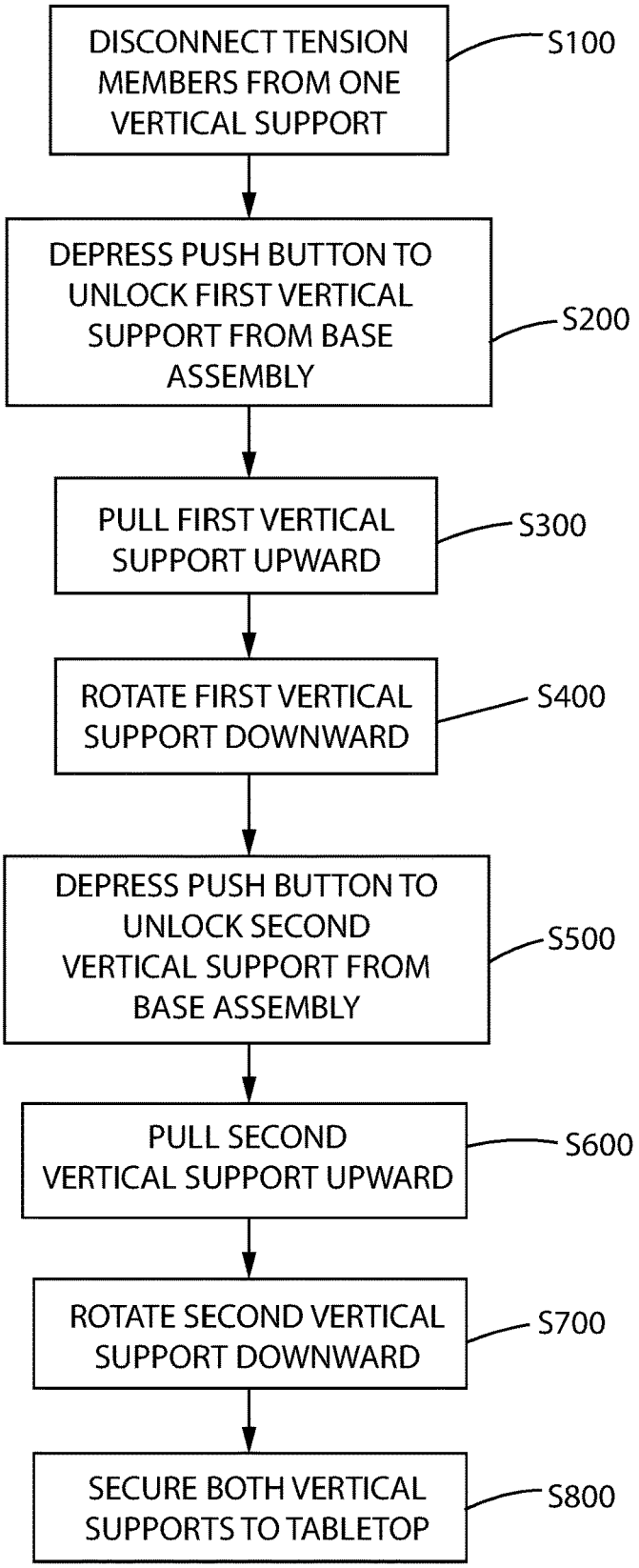
FIG. 11 is a flowchart showing an exemplary implementation of a method of storing an activity jumper in accordance with the present invention.

Referring now to FIGS. 9 and 10, the electronic counter 90 is removably connected to the front of the tabletop 11 adjacent to the rim 17. In particular, the electronic counter 90 includes a spring loaded push button 97 which actuates a latch 98 that engages a corresponding recess (not shown) on the rim 17 of the tabletop 11. Furthermore, a tab 99 on the rear of the electronic counter 90 also engages a corresponding recess (not shown) on the tabletop 11. To remove the electronic counter 90 from the tabletop 11, a user depresses the push button 97, releasing the latch 98 from the recess. The electronic counter 90 is then tipped upward, allowing the rear tab 99 to be removed from its corresponding recess.

The electronic counter 90 includes several features which provide feedback and stimulus to a child or parent. In particular, on the front of the electronic counter 90 is a digital display 95 and on the top of the counter is a speaker 96. Furthermore, although not expressly shown, a plurality of lights are contained within the electronic counter 90 itself and visible through the housing. To this end, in some embodiments of the present invention, the electronic counter 90 includes one or more translucent areas (not shown) which diffuse light emitted from an underlying light, illuminating an area of the electronic counter 90.

The exemplary electronic counter 90 shown in FIGS. 9-10 includes four buttons 91-94 which are used to operate the electronic counter 90. In particular, a first button 91 turns the electronic counter 90 on and off, a second button 92 turns certain light features on and off, a third button 93 turns on and off certain sound features, and a fourth button 94 toggles between the various functions of the electronic counter 90. One such function plays music through the speaker 96 and flashes the lights in a pattern to entice a child to jump. For example, the electronic counter 90 can, in some embodiments, reward the child with lights and sounds every set number of jumps, for example every 100 jumps. Another function counts the number of bounces a child has performed during a specific time period or session and shows the number on the display 95 for a parent to view. The electronic counter 90 can also display, for example, the count from the immediately previous session, an all-time high score, or a countdown timer so that a parent known when a child has been in the jumper for a set period of time, such as 10 minutes or 20 minutes. Of course, other auditory and/or visual features are also contemplated and can be incorporated into the electronic counter 90 without departing from the spirit and scope of the present invention.

Referring now to FIGS. 1, 2, 3, and 8, in accordance with one exemplary implementation of the method of the present invention, an exemplary activity jumper 10 of the present invention in a deployed configuration (shown in FIG. 1) is folded into a stored configuration (shown in FIG. 8). In the deployed configuration, as discussed above, the tabletop 11 is suspended by way of four tension members 26*a*-26*d* from two vertical supports 24 which are held upright by two base assemblies 22 connecting two stabilizing members 20 to form a substantially oval base. Before beginning to fold the activity jumper 10, it is preferably that the electronic counter 90 and/or all toys 15*a*-*d* are removed from the tabletop 11 according to the methods described above.

In a first step S100, the tension members 26*a*, 26*d* connected to each of the arms 60, 61 of one of the vertical supports 24 are disconnected from the tabletop 11. In particular, the clip 82 at the end of the second straps 68 are unhooked from the hooks 84*a*-*e* of the respective height adjustment means 80*a*-80*d* on the underside of the tabletop 11. The second straps 68 associated with the one vertical support 24 are then removed from the t-shaped slots 18 so that the two second straps 68 are no long connected to the tabletop 11 whatsoever. The tabletop 11 is then preferably allowed to hang from the other vertical support 24 to which it is still connected.

In a second step S200, the still connected vertical support 24 is unlocked from its respective base assembly 22. In particular, and referring now specifically to FIGS. 1-3, the base assembly 22 includes a push button 32 which is depressed to unlock the vertical support 24 from the base assembly 22. As shown in FIG. 3, the push button 32 includes a vertical panel 33 which extends downward through the main body 30 of the base assembly 22 and contacts a sloped surface 36. This sloped surface 36 is part of a locking member 35 positioned within the main body 30 of the base assembly 22. When the vertical support 24 is locked into the base assembly 22, a distal end 39 of the locking member 35 is positioned within a recess 52 defined at the lower end 51 of the vertical support 24. As such, the distal end 39 of the locking member 35 prevents the vertical support 24 from being removed from the receiving hole 41. However, as the vertical panel 33 moves downward (i.e., when the push button 32 is depressed), the vertical panel 33 slides along the sloped surface 36 of the locking member 35, causing the locking member 35 to move laterally (i.e., left in FIG. 3) until the distal end 39 of the locking member 35 is no long within the recess 52 at the lower end 51 of the vertical support 24.

Next, in a third step S300, the vertical support 24 is pulled upward until it is completely out of the receiving hole 41. As shown in FIGS. 2 and 3, the vertical support 24 includes two guide pins 53*a*, 53*b* which are positioned within respective vertical slots 42 (only one slot 42 shown in FIG. 2) defined on the sides of the channel 40 of the base assembly 22. As the vertical support 24 is pulled upward, the two guide pins 53*a*, 53*b* move along their respective slots 42 until reaching the top of the slots 42, at which point the lower end 51 of the vertical support 24 is no longer within the receiving hole 41. Of note, both the push button 32 and the locking member 35 include biasing springs 34, 38 which return the push button 32 and locking member 35 to the positions shown in FIG. 3 after the button 32 is released.

Next, in a fourth step S400, the vertical support 24 is rotated downwards towards the center of the activity jumper 10, i.e., towards the other vertical support 24. As perhaps best shown in FIG. 3, the channel 40 includes two lower surfaces 43, 44 with the outermost lower surface 43 lower than the innermost lower surface 44. Once the vertical support 24 is pulled fully upward and the two guide pins 53*a*, 53*b* reach the top of the slots 42, the lower end 51 of the of the vertical support 24 is above the outermost lower surface 43 but still below the innermost lower surface 44. As such, the vertical support 24 is prevented from rotating in the opposite direction. Of note, the two guide pins 53*a*, 53*b* within the slots 42 provide the axis of rotation for the vertical support 24. As the vertical support 24 is rotated downward, the tabletop 11, which is still connected to the rotating vertical support 24, is manipulated so that the tabletop 11 ultimately is positioned on the ground with the bottom of the tabletop 11 facing upward and the vertical support 24 resting on top of the tabletop 11 substantially parallel to the ground.

Next, in a fifth, sixth, and seventh step S500-S700, the second, and previously disconnected, vertical support 24 is unlocked (S500), pulled upward (S600), and rotated downwards towards the center of the activity jumper 10 (S700) in substantially the same manner as describe above in steps S200-S400 with respect to the first, connected vertical support 24. That is to say, the disconnected vertical support 24 is unlocked from its respective base assembly 22 by depressing the push button 32, the disconnected vertical support 24 is pulled upward until it is completely out of the receiving hole 41, and the disconnected vertical support 24 is rotated downwards towards the center of the activity jumper 10 until it too is resting on top of the tabletop 11 substantially parallel to the ground.

Lastly, in an eight step S800, the two vertical supports 24 are secured to the tabletop 11. In particular, as shown in FIG. 8, the exemplary seat 14 includes a strap 14*c* located at the bottom of the seating fabric 14*a* which is wrapped around both of the vertical supports 24. The strap 14*c* is secured by any number of means known in the art, such as a hook-and-loop fastener, buttons, snaps, clips, buckles, or the like. Advantageously, the activity jumper 10 in the stored configuration is compact and substantially flat which is convenient for storage, such as under a bed or couch.

Of course, it should be understood that the exemplary activity jumper 10 can similarly be unfolded from the stored configuration into the deployed configuration simply by reversing the order of the steps described above.

It now will be clear that the present activity jumper has unique features and advantages not found in prior activity jumpers. One or more, or even all, can be present in an activity jumper in accordance with the present disclosure. Accordingly, different combinations of features can be present based on what one wishes to have in an activity center.

What we claim is:

1. An activity jumper for a child, the activity jumper comprising:

a base;

two vertical supports operably connected to the base and extending upward from the base, each vertical support including two arms that extend away from the vertical support;

a plurality of stretchable tension members, each tension member operably connected to one of the two arms of one of the two vertical supports; and a tabletop suspended by the tension members, the tabletop having a top play surface and a central opening with a child seat disposed in the central opening;

wherein each of the tension members includes:

a first strap operably connected to one of the arms of one of the vertical supports, a second strap operably connected to the tabletop, and a piston connected to and extending between the first strap and the second strap.

2. The activity jumper of claim 1, wherein the base comprises:

two base assemblies, each base assembly configured to receive one of the two vertical supports; and two support stabilizing members connecting the two base assemblies to form a substantially oval shape.

3. The activity jumper of claim 1, wherein for each of the two vertical supports, the two arms are offset such that one of the two arms is closer to an upper end of the vertical support than the other of the two arms.

4. The activity jumper of claim 3, wherein the two arms are offset by about 2 inches.

5. The activity jumper of claim 1, wherein the first strap, the second strap, or both the first strap and the second strap are comprised of a non-elastic material.

6. The activity jumper of claim 1, wherein the piston comprises a housing and a spring enclosed by the housing;

wherein the first strap extends through the housing and connects to one end of the spring and the second strap extends through the housing and connects to another end of the spring.

7. The activity jumper of claim 6, wherein the piston further includes an additional strap enclosed by the housing, the additional strap connected to the first strap and the second strap such that the additional strap prevents the spring from extending past a maximum length.

8. The activity jumper of claim 7, wherein the maximum length is less than or equal to about 3.75 inches.

9. The activity jumper of claim 1, wherein the tabletop includes a plurality of height adjustment means, each height adjustment means comprising a plurality of hooks along a bottom of the tabletop and aligned in a row perpendicular to a perimeter of the tabletop; and wherein each of the second straps of the tension members includes a clip configured to removably engage one of the hooks of one of the height adjustment means.

10. The activity jumper of claim 9, wherein the tabletop defines t-shaped slots along the perimeter of the tabletop and adjacent to each of the height adjustment means, each of the t-shaped slots configured to removably retain the second strap in alignment with the respective height adjustment means.

11. The activity jumper of claim 1, wherein the activity jumper further includes an electronic counter removably connected to the tabletop, the electronic counter configured to that track movement of the tabletop caused by vertical movement of a child positioned in the child seat.

12. The activity jumper of claim 11, wherein the electronic counter includes lights, a speaker, or both lights and speaker.

13. An activity jumper for a child, the activity jumper comprising:

a base;

two vertical supports operably connected to the base and extending upward from the base, each vertical support including two arms that extend away from the vertical support;

a plurality of stretchable tension members, each tension member operably connected to one of the two arms of one of the two vertical supports; and a tabletop suspended by the tension members, the tabletop having a top play surface and a central opening with a child seat disposed in the central opening;

wherein the base includes:

two base assemblies, each base assembly configured to receive one of the two vertical supports, and two support stabilizing members connecting the two base assemblies to form a substantially oval shape.

14. The activity jumper of claim 13, wherein for each of the two vertical supports, the two arms are offset such that one of the two arms is closer to an upper end of the vertical support than the other of the two arms.

15. The activity jumper of claim 13, wherein each of the tension members comprises:

a first strap operably connected to one of the arms of one of the vertical supports;

a second strap operably connected to the tabletop; and a piston connected to and extending between the first strap and the second strap, the piston including a housing and a spring enclosed by the housing with the first strap extending through the housing and connecting to one end of the spring and the second strap extending through the housing and connecting to another end of the spring.

16. An activity jumper for a child, the activity jumper comprising:

a base;

two vertical supports operably connected to the base and extending upward from the base, each vertical support including two arms that extend away from the vertical support;

a plurality of stretchable tension members, each tension member including a first strap operably connected to one of the arms of one of the vertical supports, a piston connected to the first strap opposite the arm, and a second strap connected to the piston opposite the first strap; and a tabletop connected to each of the second straps of the plurality of tension members such that the tabletop is suspended by the tension members, the tabletop having a top play surface and a central opening with a child seat disposed in the central opening.

17. The activity jumper of claim 16, wherein, for each tension member, the piston comprises a housing and a spring enclosed by the housing;

wherein the first strap extends through the housing and connects to one end of the spring and the second strap extends through the housing and connects to another end of the spring.

18. The activity jumper of claim 17, wherein, for each tension member, the piston further includes an additional strap enclosed by the housing, the additional strap connected to the first strap and the second strap such that the additional strap prevents the spring from extending past a maximum length.

19. The activity jumper of claim 18, wherein the maximum length is less than or equal to about 3.75 inches.

20. The activity jumper of claim 16, wherein, for each tension member, the first strap, the second strap, or both the first strap and the second strap are comprised of a non-elastic material.

21. The activity jumper of claim 16, wherein the base comprises:

two base assemblies, each base assembly configured to receive one of the two vertical supports; and two support stabilizing members connecting the two base assemblies to form a substantially oval shape.

22. The activity jumper of claim 16, wherein for each of the two vertical supports, the two arms are offset such that one of the two arms is closer to an upper end of the vertical support than the other of the two arms.

23. The activity jumper of claim 16, wherein the tabletop includes a plurality of height adjustment means, each height adjustment means comprising a plurality of hooks along a bottom of the tabletop and aligned in a row perpendicular to a perimeter of the tabletop; and wherein each of the second straps of the tension members includes a clip configured to removably engage one of the hooks of one of the height adjustment means.

24. The activity jumper of claim 23, wherein the tabletop defines t-shaped slots along the perimeter of the tabletop and adjacent to each of the height adjustment means, each of the t-shaped slots configured to removably retain the second strap in alignment with the respective height adjustment means.

25. An activity jumper for a child, the activity jumper comprising:

two base assemblies connected by two support stabilizing members to form a substantially oval shape, each base assembly including a main body defining a lateral channel and further defining a hole extending downward from a bottom of the channel;

two vertical supports, each vertical support inserted into the hole of the main body of one of the base assemblies such that the vertical support extends upward from the base assembly, and each vertical support including two arms that extend away from the vertical support;

a plurality of stretchable tension members, each tension member operably connected to one of the two arms of one of the two vertical supports; and a tabletop suspended by the tension members, the tabletop having a top play surface and a central opening with a child seat disposed in the central opening.

26. The activity jumper of claim 25, wherein each base assembly further includes:

a locking member positioned within the main body, the locking member having a distal end that, when the vertical support is inserted into the hole of the main body, engages a recess defined at a lower end of the vertical support, the locking member further including a sloped surface; and a push button having a vertical panel which extends downward through the main body and contacts the sloped surface of the locking member, such that, when the push button is depressed, the vertical panel slides along the sloped surface of the locking member, causing the locking member to move laterally until the distal end of the locking member no longer engages the recess of the vertical support.

27. The activity jumper of claim 25, wherein the main body of each base assembly further defines a pair of vertical slots along sides of the channel: and wherein each vertical support includes a pair of guide pins positioned within the slots to constrain movement of the vertical support relative to the base assembly.

28. A method of storing an activity jumper comprising the steps of:

providing an activity jumping including two base assemblies including a main body defining a lateral channel and further defining a hole extending downward from a bottom of the channel, each base assembly further including a locking member positioned within the main body, the locking member having a sloped surface and a distal end and a push button having a vertical panel which extends downward through the main body and contacts the sloped surface of the locking member, two vertical supports, each vertical support inserted into the hole of the main body of one of the base assemblies such that a recess defined in a lower end of the vertical support is engaged by the distal end of the locking member, the vertical support extending upward from the base assembly and terminating at an upper end with two arms that extend away from the vertical support, a plurality of stretchable tension members, each tension member operably connected to one of the two arms of one of the two vertical supports, and a tabletop suspended by the tension members, the tabletop having a top play surface and a central opening with a child seat disposed in the central opening;

depressing the push button such that the vertical panel moves downward and slides along the sloped surface of the locking member, causing the locking member to move until the distal end of the locking member no long engages the recess at the lower end of the vertical support;

pulling the vertical support upward until it is no longer in the hole of the main body; and rotating the vertical support downward.

* * * * *